US009335701B2

(12) United States Patent
Michigami

(10) Patent No.: US 9,335,701 B2
(45) Date of Patent: May 10, 2016

(54) IMAGE FORMING APPARATUS

(71) Applicant: KYOCERA Document Solutions Inc., Osaka (JP)

(72) Inventor: Toru Michigami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/869,229

(22) Filed: Sep. 29, 2015

(65) Prior Publication Data

US 2016/0091855 A1 Mar. 31, 2016

(30) Foreign Application Priority Data

Sep. 30, 2014 (JP) ..... 2014-201248

(51) Int. Cl.
*G03G 15/00* (2006.01)
*G03G 21/00* (2006.01)
*B65H 37/04* (2006.01)

(52) U.S. Cl.
CPC ..... *G03G 15/6544* (2013.01); *B65H 37/04* (2013.01)

(58) Field of Classification Search
CPC ..... G03G 15/00; G03G 21/00; B65H 37/04
USPC ..... 399/408
See application file for complete search history.

(56) References Cited

U.S. PATENT DOCUMENTS 6,357,737 B1 * 3/2002 Yoshida ..... H04N 1/00567 270/58.08
2009/0137374 A1 * 5/2009 Kobayashi ..... B65H 45/18 493/424

FOREIGN PATENT DOCUMENTS

JP H11-139668 A 5/1999
JP 2002113921 A * 4/2002 ..... B65H 37/04

* cited by examiner

*Primary Examiner* — Nguyen Ha
(74) *Attorney, Agent, or Firm* — Studebaker & Brackett PC

(57) ABSTRACT

An image forming apparatus includes a storage section and a job executing section including a printing section and a finishing processing section. The finishing processing section performs stapling processing on a paper sheaf based on a stapling pattern designated by a user that stipulates position and number of one or more stapling points. The storage section stores a threshold sheet number as a determination criterion for whether to execute damage restriction processing. When a target paper sheaf is smaller than the threshold sheet number, the job executing section executes, as the damage restriction processing, one or more of: first processing of ejecting paper without stapling processing; second processing of performing stapling processing after increasing the number of sheets in the target paper sheaf to the threshold sheet number; and third processing of performing stapling processing at a larger number of stapling points than stipulated by the designated stapling pattern.

7 Claims, 6 Drawing Sheets

IMAGE FORMING APPARATUS

INCORPORATION BY REFERENCE

The present application claims priority under 35 U.S.C. §119 to Japanese Patent Application No. 2014-201248, filed on Sep. 30, 2014. The contents of this application are incorporated herein by reference in their entirety.

BACKGROUND

The present disclosure relates to image forming apparatuses that can perform stapling processing on paper sheaves.

An image forming apparatus may include a finishing processing section. The finishing processing section performs stapling processing on a paper sheaf. In such an image forming apparatus, there is usually a predetermined maximum number of sheets of paper that can be stapled.

In one example, the image forming apparatus stores a maximum stapling sheet number determination table that stipulates the maximum number of sheets that can be stapled (maximum staplable sheet number) for each different paper manufacturer or for each of a plurality of different paper thicknesses. Upon paper information being input to the image forming apparatus by a user, the image forming apparatus determines a most suitable maximum staplable sheet number from among the maximum staplable sheet numbers stipulated by the maximum stapling sheet number determination table, based on the input paper information.

SUMMARY

An image forming apparatus according to the present disclosure includes a job executing section and a storage section that stores information. The job executing section includes a printing section that prints an image on paper and a finishing processing section. The finishing processing section performs stapling processing on a paper sheaf composed of a plurality of sheets of paper conveyed from the printing section. The finishing processing section performs the stapling processing based on a stapling pattern designated by a user from among a plurality of stapling patterns that each stipulates a position of each of one or more stapling points and the number of stapling points. The storage section stores a threshold sheet number indicating a predetermined minimum number of paper sheaf sheets that is used as a determination criterion for whether or not to execute damage restriction processing. When the number of sheets in a target paper sheaf that is a target of the stapling processing is smaller than the threshold sheet number, the job executing section executes, as the damage restriction processing, one or more of: first processing of ejecting paper without performing the stapling processing; second processing of performing the stapling processing after increasing the number of sheets in the target paper sheaf to the threshold sheet number; and third processing of performing the stapling processing at a larger number of stapling points than the number of stapling points stipulated by the stapling pattern designated by the user.

DETAILED DESCRIPTION

An image forming apparatus according to an embodiment of the present disclosure is explained using a multifunction peripheral as an example of the image forming apparatus.

<Multifunction Peripheral Overall Configuration>

Figure 1:
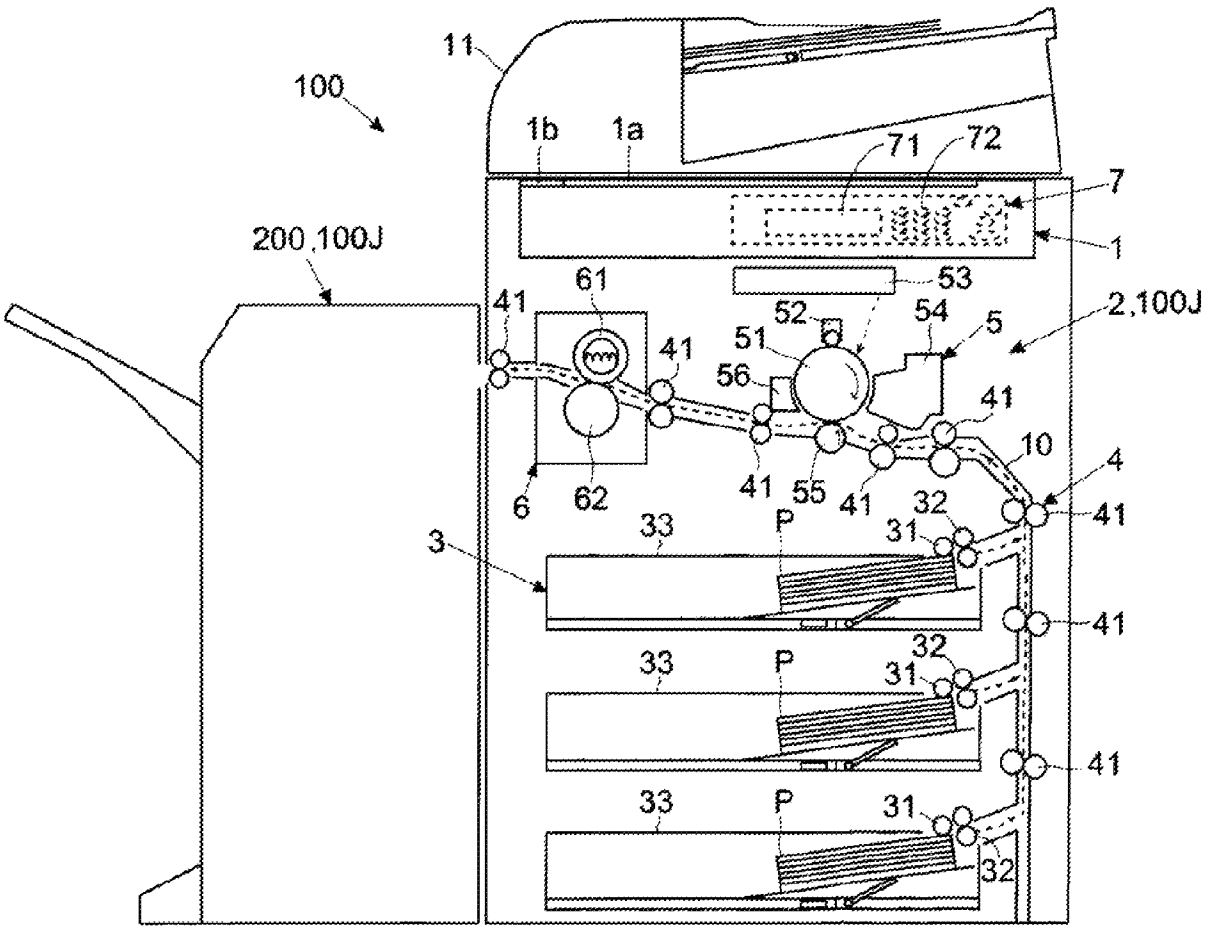
FIG. 1 is an overview diagram illustrating an example of a multifunction peripheral according to an embodiment of the present disclosure.

A multifunction peripheral 100 illustrated in FIG. 1 includes an image scanning section 1 and a printing section 2. The multifunction peripheral 100 is equivalent to the "image forming apparatus" of the present disclosure.

The image scanning section 1 generates image data for a document placed on contact glass 1*a* by scanning the document. The contact glass 1*a* is used for placed scanning. A document conveyance unit 11 that conveys a document over contact glass 1*b* is attached to the image scanning section 1. The contact glass 1*b* is used for conveyed scanning. When the document conveyance unit 11 conveys a document over the contact glass 1*b*, the image scanning section 1 generates image data for the document by scanning the document as the document passes over the contact glass 1*b*.

The printing section 2 includes a paper feed section 3, a paper conveyance section 4, an image forming section 5, and a fixing section 6. The printing section 2 conveys paper P along a main body conveyance path 10. The printing section 2 prints an image on the conveyed paper P based on image data. For example, the printing section 2 may print an image on the paper P based on image data for a document that is generated through scanning of the document by the image scanning section 1 (copy job). In another example, the printing section 2 may print an image on the paper P based on image data that a communication section 113 explained further below receives from a user terminal 300 (print job).

The paper feed section 3 includes a pickup roller 31 and a pair of paper feed rollers 32. The paper feed section 3 feeds paper P into the main body conveyance path 10 from a paper feed cassette 33 in which the paper P is loaded. The paper conveyance section 4 includes pairs of conveyance rollers 41. The paper conveyance section 4 conveys the paper P along the main body conveyance path 10. It should be noted that the printing section 2 of the multifunction peripheral 100 includes a plurality of the paper feed cassettes 33. In other words, the multifunction peripheral 100 can be loaded with various different types of paper P at the same time. For example, each of the paper feed cassettes 33 may be loaded with paper P that differs from paper P loaded in the other paper feed cassettes 33 in terms of paper thickness or strength. Furthermore, each of the paper feed cassettes 33 may be loaded with paper P that differs to paper P loaded in the other paper feed cassettes 33 in terms of size. It should also be noted that each of the paper feed cassettes 33 may alternatively be loaded with paper P of the same paper thickness, strength, or size.

The image forming section 5 includes a photosensitive drum 51, a charging device 52, a light exposure device 53, a developing device 54, a transfer roller 55, and a cleaning device 56. The image forming section 5 forms a toner image based on image data. The image forming section 5 then transfers the toner image onto paper P. The fixing section 6 includes a heating roller 61 and a pressure roller 62. The fixing section 6 fixes the transferred toner image to the paper P by applying heat and pressure to the toner image.

The multifunction peripheral 100 also includes an operation panel 7. The operation panel 7 includes a liquid-crystal display panel 71 equipped with a touch panel. The liquid-crystal display panel 71 for example displays soft keys, a message, or a combination thereof. The soft keys receive various settings. The operation panel 7 also includes hard keys such as a numeric keypad and a start key.

Herein, the multifunction peripheral 100 includes a finishing processing section 200. The multifunction peripheral 100 including the finishing processing section 200 can perform finishing processing on paper P once printing is complete, using the finishing processing section 200. The finishing processing section 200 for example performs processing such as punching processing or stapling processing on paper P once printing is complete.

In the configuration of the multifunction peripheral 100, the printing section 2 and the finishing processing section 200 are equivalent to the "job executing section". In the following description, the printing section 2 and the finishing processing section 200 are also collectively referred to as a job executing section 100J.

<Finishing Processing Section Configuration>

Figure 2:
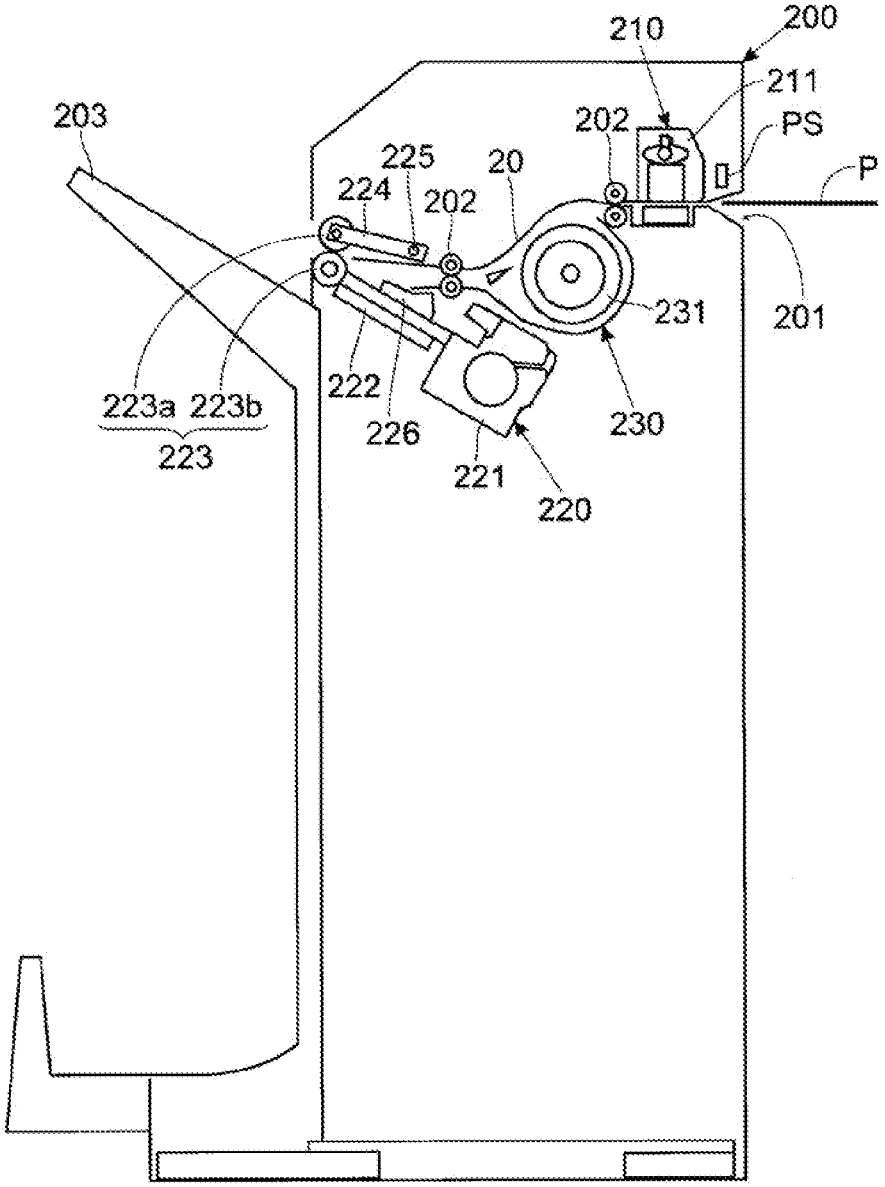
FIG. 2 is an overview diagram illustrating an example of a finishing processing section provided in the multifunction peripheral according to the embodiment of the present disclosure.

As illustrated in FIG. 2, the finishing processing section 200 includes a conveyance inlet 201. The conveyance inlet 201 is an inlet for receiving paper P conveyed from the printing section 2 once printing is complete. After paper P is conveyed in through the conveyance inlet 201, the finishing processing section 200 conveys the paper P along a finishing processing conveyance path 20. The finishing processing section 200 performs finishing processing on the paper P conveyed along the finishing processing conveyance path 20. In order to perform the finishing processing, pairs of conveyance rollers 202 are provided in the finishing processing section 200. The pairs of conveyance rollers 202 convey the paper P along the finishing processing conveyance path 20. The finishing processing section 200 includes a punching processing section 210 and a stapling processing section 220 as sections that perform finishing processing.

The punching processing section 210 includes a punching unit 211. The punching unit 211 is located in an upstream part of the finishing processing conveyance path 20 in terms of a conveyance direction of the paper P; in other words, the punching unit 211 is located in proximity to the conveyance inlet 201. The punching unit 211 performs punching processing on paper P that is conveyed in through the conveyance inlet 201.

The stapling processing section 220 includes a stapling unit 221 and a processing tray 222. The stapling processing section 220 is located in a downstream part of the finishing processing conveyance path 20 in terms of the conveyance direction of paper P. The stapling unit 221 performs stapling processing on a sheaf of paper stacked on the processing tray 222. The paper sheaf is composed of a plurality of sheets of paper P. The stapling unit 221 is moveably attached relative to the processing tray 222. When the stapling unit 221 performs stapling processing on the paper sheaf, the stapling unit 221 moves based on a stapling pattern designated by a user. The term stapling pattern refers to a pattern that stipulates a position of each of one or more stapling points and the number of stapling points.

The processing tray 222 is inclined diagonally downward from an end closest to an exit tray 203. A pair of ejection rollers 223 is located at the end of the processing tray 222 closest to the exit tray 203. The pair of ejection rollers 223 ejects paper P onto the exit tray 203. The pair of ejection rollers 223 includes an upper roller 223*a* and a lower roller 223*b*. The upper roller 223*a* is connected to one end of an arm 224. The other end of the arm 224 is connected to a pivot shaft 225. The upper roller 223*a* therefore moves upward when the one end of the arm 224 pivots upward about the pivot shaft 225 as a fulcrum. As a result, the arm 224 can separate the upper roller 223*a* from the lower roller 223*b*. On the other hand, the upper roller 223*a* moves downward when the one end of the arm 224 pivots downward about the pivot shaft 225 as a fulcrum. As a result, the arm 224 can move the upper roller 223*a* toward the lower roller 223*b*.

When paper P is to be stacked on the processing tray 222, the arm 224 separates the upper roller 223*a* from the lower roller 223*b*. As a result, a leading edge of the paper P becomes positioned between the upper roller 223*a* and the lower roller 223*b*. Once in the above position, a paddle (not illustrated) for example moves the paper P in a diagonal downward direction along the stacking surface of the processing tray 222. Alternatively, the weight of the paper P may cause the paper P to move in the diagonal downward direction along the stacking surface of the processing tray 222.

When paper P is to be ejected onto the exit tray 203 from the processing tray 222, the arm 224 moves the upper roller 223*a* toward the lower roller 223*b* such that the paper P becomes sandwiched between the upper roller 223*a* and the lower roller 223*b*. Subsequent rotation of the upper roller 223*a* and the lower roller 223*b* causes the paper P stacked on the processing tray 222 to be ejected onto the exit tray 203.

A guide 226 is provided on the processing tray 222. The guide 226 is moveable in a width direction of paper P—that is, a direction perpendicular to the conveyance direction of paper P. Provision of the guide 226 on the processing tray 222 enables shifting in the width direction of paper P that is to be ejected onto the exit tray 203. In other words, the guide 226 enables sorting of the paper P.

A holding section 230 is located in a central part of the finishing processing conveyance path 20. In other words, the holding section 230 is located between the punching processing section 210 and the stapling processing section 220. The holding section 230 temporarily holds paper P that is conveyed from the punching processing section 210. The holding section 230 includes a holding drum 231 that is supported in a rotatably drivable manner. The holding section 230 temporarily holds the paper P conveyed from the punching processing section 210 by causing the paper P to wrap around the holding drum 231. In other words, the holding section 230 delays conveyance of the paper P to the stapling processing section 220. Through the above configuration, when a preceding paper sheaf is being processed by the stapling processing section 220, it is possible to restrict conveyance of sheets of paper Pin a following paper sheaf to the stapling processing section 220.

<Multifunction Peripheral Hardware Configuration>

Figure 3:
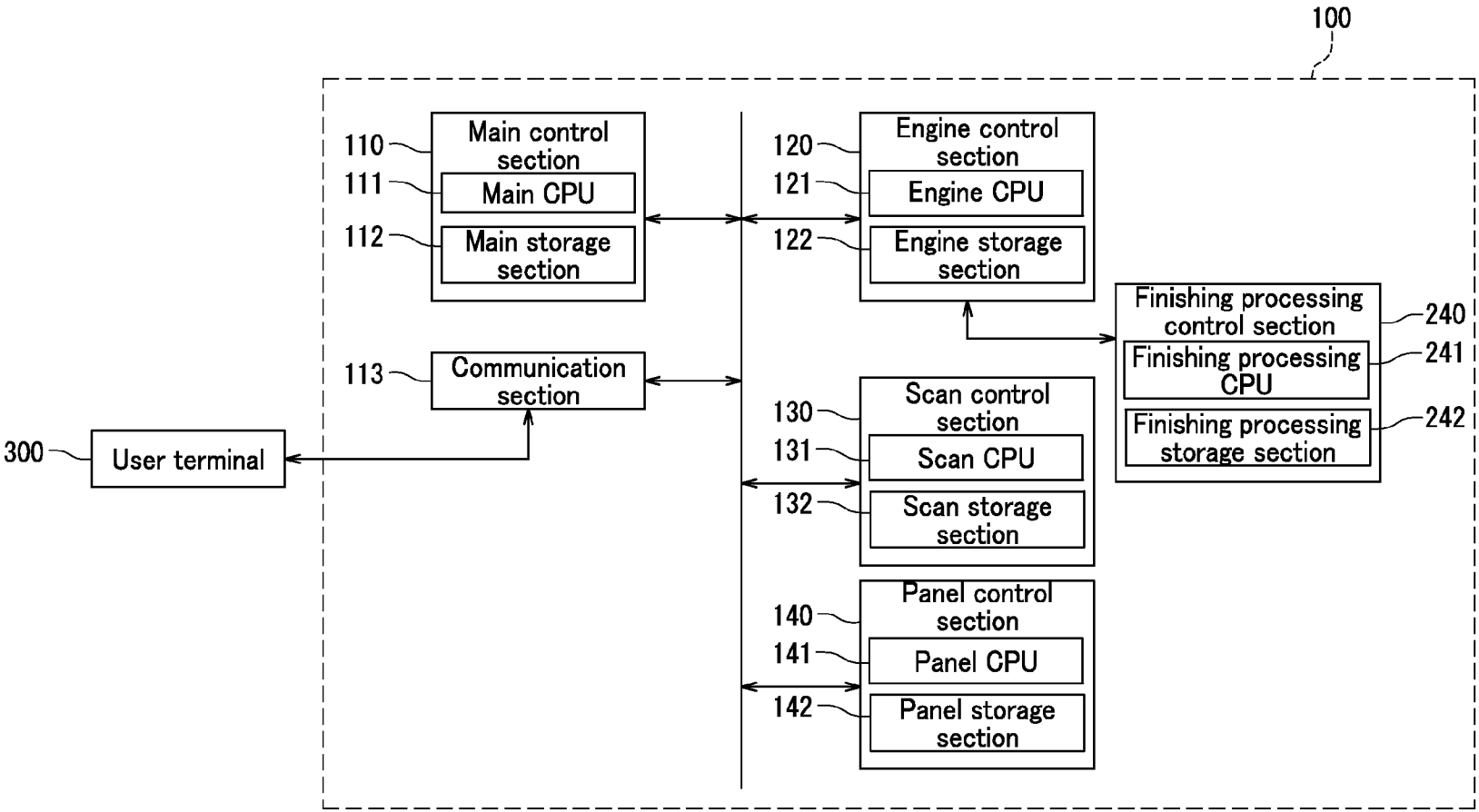
FIG. 3 is a block diagram illustrating an example of hardware configuration of the multifunction peripheral according to the embodiment of the present disclosure.

As illustrated in FIG. 3, the multifunction peripheral 100 includes a main control section 110. The main control section 110 includes a main CPU 111 and a main storage section 112. The main storage section 112 stores a program for causing operation of the main CPU 111. The main CPU 111 of the main control section 110 for example performs overall control of the multifunction peripheral 100 and image processing control. The main control section 110 is connected to an engine control section 120, a scan control section 130, and a panel control section 140, and gives instructions to each of the aforementioned control sections.

The engine control section 120 includes an engine CPU 121 and an engine storage section 122. The engine storage section 122 stores a program for causing operation of the engine CPU 121. The engine CPU 121 of the engine control section 120 receives instructions from the main control section 110 and controls printing operation of the printing section 2. The engine control section 120 is communicably connected to a finishing processing control section 240.

The finishing processing control section 240 includes a finishing processing CPU 241 and a finishing processing storage section 242. The finishing processing storage section 242 stores a program for causing operation of the finishing processing CPU 241. The finishing processing CPU 241 of the finishing processing control section 240 receives instructions from the engine control section 120 and controls finishing processing operation of the finishing processing section 200.

The scan control section 130 includes a scan CPU 131 and a scan storage section 132. The scan storage section 132 stores a program for causing operation of the scan CPU 131. The scan CPU 131 of the scan control section 130 receives instructions from the main control section 110 and controls scanning operation of the image scanning section 1.

The panel control section 140 includes a panel CPU 141 and a panel storage section 142. The panel storage section 142 stores a program for causing operation of the panel CPU 141. The panel CPU 141 of the panel control section 140 receives instructions from the main control section 110 and controls display operation of the operation panel 7. The panel CPU 141 also receives instructions from the main control section 110 and detects operations performed on the operation panel 7. When the panel control section 140 detects an operation performed on the operation panel 7, the panel control section 140 notifies a detection result to the main control section 110.

The main control section 110 is also connected to the communication section 113. The communication section 113 is communicably connected to the user terminal 300 via a network. The user terminal 300 is for example a personal computer that is used by a user. The communication section 113 receives instructions from the main control section 110 and communicates with the user terminal 300. For example, the communication section 113 receives print data from the user terminal 300. The print data includes image data. The communication section 113 also transmits image data to the user terminal 300.

<Stapling Processing>

The printing section 2 prints an image on paper P based on image data by executing a copy job or a print job. The printing section 2 conveys the paper P to the finishing processing section 200 once printing is complete. In the above situation, if the finishing processing section 200 receives an execution instruction for stapling processing, the finishing processing section 200 performs stapling processing on a paper sheaf composed of a plurality of sheets of the paper P conveyed from the printing section 2. The finishing processing section 200 performs the stapling processing based on a stapling pattern designated by the user. If the finishing processing section 200 does not receive an execution instruction for stapling processing, the finishing processing section 200 ejects the paper P conveyed from the printing section 2 without further processing.

Figure 4:
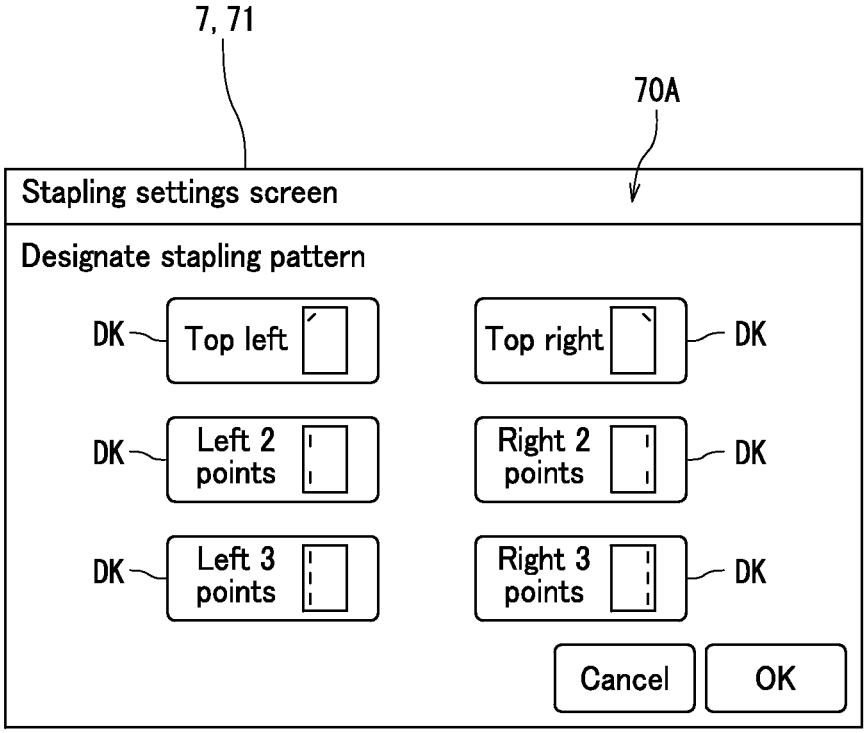
FIG. 4 illustrates an example of a stapling settings screen displayed on an operation panel of the multifunction peripheral according to the embodiment of the present disclosure.

The operation panel 7 receives settings relating to execution conditions of a copy job before the copy job is executed. When receiving the settings, the operation panel 7 also receives a setting indicating whether or not stapling processing is to be executed. Upon receiving the setting indicating whether or not stapling processing is to be executed, the operation panel 7 displays a stapling settings screen 70A illustrated in FIG. 4. The stapling settings screen 70A includes designation keys DK for designating stapling patterns. The designation keys DK correspond one-to-one to various stapling patterns. Each of the designation keys DK has information displayed thereon that indicates the stapling pattern corresponding to the designation key DK. The information indicating the stapling pattern is for example text, a diagram, or a combination thereof. When any one of the designation keys DK is touched, the stapling pattern corresponding to the touched designation key DK is designated.

When "Top left" is designated in the stapling settings screen 70A, the stapling processing is performed at one stapling point at the top left of the paper sheaf. When "Top right" is designated, the stapling processing is performed at one stapling point at the top right of the paper sheaf. When "Left 2 points" is designated, the stapling processing is performed at two stapling points on the left-hand side of the paper sheaf. When "Right 2 points" is designated, the stapling processing is performed at two stapling points on the right-hand side of the paper sheaf. When "Left 3 points" is designated, the stapling processing is performed at three stapling points on the left-hand side of the paper sheaf. When "Right 3 points" is designated, the stapling processing is performed at three stapling points on the right-hand side of the paper sheaf. Although not illustrated, four or more stapling points may be set for a single paper sheaf. In such a situation, the stapling processing section 220 performs the stapling processing at four stapling points on the single paper sheaf. Also, a setting may be made for performing the stapling processing at the top end of the paper sheaf. In such a situation, the stapling processing section 220 performs the stapling processing at the top end of the single paper sheaf.

The user terminal 300 receives settings relating to execution conditions of a print job before the print job is executed. When receiving the settings, the user terminal 300 also receives a setting indicating whether or not stapling processing is to be executed. When the user terminal 300 transmits print data to the multifunction peripheral 100, the user terminal 300 also transmits stapling information. The stapling information indicates whether or not stapling processing is to be executed. In a situation in which the user terminal 300 receives a setting for executing stapling processing, the user terminal 300 includes information indicating a stapling pattern designated by the user in the stapling information.

<Damage Restriction Processing>

In the present embodiment, the job executing section 100J can execute damage restriction processing on a paper sheaf that is a target of stapling processing. The damage restriction processing is processing that restricts damage from occurring to the paper sheaf. In the following description, a paper sheaf that is a target of stapling processing is referred to as a target paper sheaf. More specifically, the main storage section 112 stores a threshold sheet number. In other words, the main storage section 112 is equivalent to the "storage section". The threshold sheet number is a predetermined minimum number of sheets of paper P in a paper sheaf that is used as a criterion for determining whether or not to execute the damage restriction processing. It should be noted that the threshold sheet number may alternatively be stored in the engine storage section 122 or the finishing processing storage section 242.

The damage restriction processing is executed when the number of sheets in the target paper sheaf is smaller than the threshold sheet number.

The threshold sheet number used as the criterion for determining whether or not to execute the damage restriction processing can be obtained experimentally or empirically. For example, the stapling processing section 220 may be used to actually perform stapling processing on paper sheaves composed of different numbers of sheets. The user obtains a minimum number of paper sheaf sheets on which stapling processing is executed for which damage can be restricted from occurring and sets the threshold sheet number as the obtained minimum number of paper sheaf sheets.

The likelihood of damage occurring to a paper sheaf varies depending on the number of stapling points. Damage tends to occur more easily to a paper sheaf when the number of stapling points is small. For example, in a situation in which there is only one stapling point, force generated when a user pulls on sheets of paper P in the paper sheaf is concentrated on the one point. On the other hand, in a situation in which there are two stapling points, force generated when the user pulls on sheets of paper P in the paper sheaf is distributed between the two points. Therefore, damage tends to occur more easily to a paper sheaf that only has one stapling point than to a paper sheaf that has two stapling points in a situation which both of the paper sheaves are composed of the same number of sheets. Therefore, the main storage section 112 stores a threshold sheet number for each of a plurality of stapling patterns. The threshold sheet numbers are set such that the larger the number of stapling points stipulated by each of the stapling patterns, the smaller the threshold sheet number corresponding to the stapling pattern.

For example, suppose that a threshold sheet number of 6 is set for when there is one stapling point and a threshold sheet number of 3 is set for when there are two stapling points. Also suppose that the number of sheets in the target paper sheaf is 5. In such a situation, when the user designates a stapling pattern that stipulates one stapling point, the threshold sheet number of 6 is used. Therefore, the number of sheets in the target paper sheaf (5 sheets) is smaller than the threshold sheet number (6 sheets). As a result, the stapling processing section 220 executes the damage restriction processing. On the other hand, when the user designates a stapling pattern that stipulates two stapling points, the threshold sheet number of 3 is used. Therefore, the number of sheets in the target paper sheaf (5 sheets) is larger than the threshold sheet number (3 sheets). As a result, the stapling processing section 220 does not execute the damage restriction processing.

The likelihood of damage occurring to a paper sheaf also varies depending on the paper thickness of paper P from which the paper sheaf is composed. More specifically, paper P having a smaller paper thickness tends to be weaker. Therefore, damage tends to occur to a paper sheaf more easily when the paper sheaf is composed of paper P having a small paper thickness. In consideration of the above, threshold sheet numbers are also categorized for each of a plurality of different paper thicknesses. The threshold sheet numbers are set such that for threshold sheet numbers corresponding to the same stapling pattern, the larger each of the paper thicknesses, the smaller the threshold sheet number corresponding to the paper thickness.

The main control section 110 performs a determination of whether or not to execute the damage restriction processing. The main control section 110 detects the number of sheets in the target paper sheaf in order to determine whether or not to execute the damage restriction processing. More specifically, in a situation in which a copy job involving stapling processing is executed, the main control section 110 determines the number of sheets in the target paper sheaf based on image data of a document that is obtained through scanning of the document by the image scanning section 1. In a situation in which a print job involving stapling processing is executed, the main control section 110 determines the number of sheets in the target paper sheaf based on print data received from the user terminal 300. The number of sheets in the target paper sheaf may increase or decrease depending on whether or not functions such as duplex printing and/or N-up printing are executed. Therefore, when the main control section 110 detects the number of sheets in the target paper sheaf, the main control section 110 also checks settings of functions such as duplex printing and/or N-up printing that affect the number of sheets that are printed.

Next, the main control section 110 determines a stapling pattern designated by the user. The main control section 110 also determines the paper thickness of paper P loaded in a paper feed cassette 33 designated by the user—that is, a paper feed cassette 33 designated by the user as a feed source. Paper thicknesses of paper P loaded in the paper feed cassettes 33 are pre-registered by the user and are stored in the main storage section 112 as paper thickness information. Therefore, the main control section 110 determines the paper thickness based on the paper thickness information stored in the main storage section 112. Alternatively, the multifunction peripheral 100 may include a separate paper thickness determination section. The paper thickness determination section determines the paper thicknesses of paper P loaded in the paper feed cassettes 33. The paper thickness determination section can for example use optical sensors or ultrasound sensors. The optical sensors detect paper thickness using transmission or reflection of light. The ultrasound sensors detect paper thickness using transmission or reflection of ultrasound.

After determining the stapling pattern designated by the user and the paper feed cassette 33 designated by the user, the main control section 110 determines a threshold sheet number that corresponds to the stapling pattern designated by the user and that also corresponds to the paper thickness of paper P loaded in the paper feed cassette 33 designated by the user. When the number of sheets in the target paper sheaf is smaller than the determined threshold sheet number, the main control section 110 instructs the job executing section 100J to execute the damage restriction processing. During the above, the main control section 110 selects processing to be executed by the job executing section 100J as the damage restriction processing from among first processing, second processing, third processing, and fourth processing explained below.

Upon receiving an execution instruction for the first processing, the job executing section 100J ejects paper P without performing the stapling processing. More specifically, the printing section 2 conveys paper P loaded in the paper feed cassette 33 designated by the user and prints an image on the paper P based on image data of a printing target. The printing section 2 conveys the paper P toward the finishing processing section 200 once printing is complete. Next, the finishing processing section 200 ejects the paper P conveyed from the printing section 2 without performing the stapling processing on the paper P.

Upon receiving an execution instruction for the second processing, the job executing section 100J performs the stapling processing on the target paper sheaf after increasing the number of sheets in the target paper sheaf to the threshold sheet number. More specifically, the printing section 2 conveys paper P loaded in the paper feed cassette 33 designated by the user and prints an image on the paper P based on image data of a printing target. The printing section 2 conveys the paper P to the finishing processing section 200 once printing is complete. The printing section 2 then continues to convey paper P to the finishing processing section 200 until the number of sheets of paper P conveyed to the finishing processing section 200 reaches the threshold sheet number. In other words, the printing section 2 conveys additional paper P to the finishing processing section 200. It should be noted that printing is not performed on the conveyed additional paper P. In other words, the conveyed additional paper P remains as blank paper. Alternatively, a pre-registered image may be printed on the conveyed additional paper P. The pre-registered image is for example an advertisement image. Next, the finishing processing section 200 performs the stapling processing on the target paper sheaf, which is composed of the paper P on which the image is printed based on the image data of the printing target and the additional paper P that is conveyed. The finishing processing section 200 performs the stapling processing at stapling points stipulated by the stapling pattern designated by the user. Next, the finishing processing section 200 ejects the target paper sheaf once the stapling processing is complete.

Upon receiving an execution instruction for the third processing, the job executing section 100J performs the stapling processing at a larger number of stapling points than the number of stapling points stipulated by the stapling pattern designated by the user. More specifically, the printing section 2 conveys paper P loaded in the paper feed cassette 33 designated by the user and prints an image on the paper P based on image data of a printing target. The printing section 2 conveys the paper P to the finishing processing section 200 once printing is complete. Next, the finishing processing section 200 performs the stapling processing on the target paper sheaf, which is composed of a plurality of sheets of the paper P conveyed from the printing section 2. The above stapling processing is performed based on a stapling pattern, from among the plurality of stapling patterns, for which the corresponding threshold sheet number is no larger than the number of sheets in the target paper sheaf. In other words, the finishing processing section 200 performs the stapling processing at stapling points stipulated by a stapling pattern, among the plurality of stapling patterns, for which the corresponding threshold sheet number is no larger than the number of sheets in the target paper sheaf. Next, the finishing processing section 200 ejects the target paper sheaf once the stapling processing is complete.

Upon receiving an execution instruction for the fourth processing, the job executing section 100J prints an image based on image data of a printing target on paper P that has a larger paper thickness than a paper thickness of paper P loaded in the paper feed cassette 33 designated by the user and conveys the printed paper P to the finishing processing section 200. More specifically, the printing section 2 sets, as a feed source from among the plurality of paper feed cassettes 33, a paper feed cassette 33 loaded with paper P having a paper thickness for which the corresponding threshold sheet number is no larger than the number of sheets in the target paper sheaf, conveys paper P from the aforementioned paper feed cassette 33, and prints an image on the paper P based on image data of a printing target. The printing section 2 conveys the paper P toward the finishing processing section 200 once printing is complete. Next, the finishing processing section 200 performs the stapling processing on the target paper sheaf, which is composed of a plurality of sheets of the paper P conveyed from the printing section 2, at stapling points stipulated by the stapling pattern designated by the user. The finishing processing section 200 subsequently ejects the target paper sheaf once the stapling processing is complete.

Processing that is a combination of two or more of the second processing, the third processing, and the fourth processing can be set as the damage restriction processing. In an example in which the second processing and the third processing are combined, the job executing section 100J increases the number of sheets in the target paper sheaf to the threshold sheet number and performs the stapling processing at a larger number of stapling points than stipulated by the stapling pattern designated by the user. In another example in which the third processing and the fourth processing are combined, the job executing section 100J prints an image on paper P having a larger paper thickness than a paper thickness of paper P loaded in the paper feed cassette 33 designated by the user and performs the stapling processing at a larger number of stapling points than stipulated by the stapling pattern designated by the user. In an example in which the second processing and the fourth processing are combined, the job executing section 100J prints an image on paper P having a larger paper thickness than a paper thickness of paper P loaded in the paper feed cassette 33 designated by the user and increases the number of sheets in the target paper sheaf to the threshold sheet number. Processing that is a combination of the second processing, the third processing, and the fourth processing may alternatively be set as the damage restriction processing.

However, in a situation in which there is only one paper feed cassette 33, or in which a plurality of paper feed cassettes 33 are loaded with paper P having the same paper thickness, the main control section 110 selects processing to be executed by the job executing section 100J as the damage restriction processing from among the first processing, the second processing, and the third processing. The fourth processing is not a selection option in the above situation. In other words, only in a situation in which a plurality of paper feed cassettes 33 are loaded with paper P of different paper thicknesses relative to one another does the main control section 110 select processing to be executed by the job executing section 100J as the damage restriction processing from among the first processing, the second processing, the third processing, and the fourth processing.

The user selects processing to be executed as the damage restriction processing from among the first processing, the second processing, the third processing, and the fourth processing. The selection of processing to be executed as the damage restriction processing is for example received by the operation panel 7. In such a configuration, the operation panel 7 is equivalent to the "reception section". In an alternative configuration, the selection of processing to be executed by the job executing section 100J as the damage restriction processing may be received by the user terminal 300.

Figure 5:
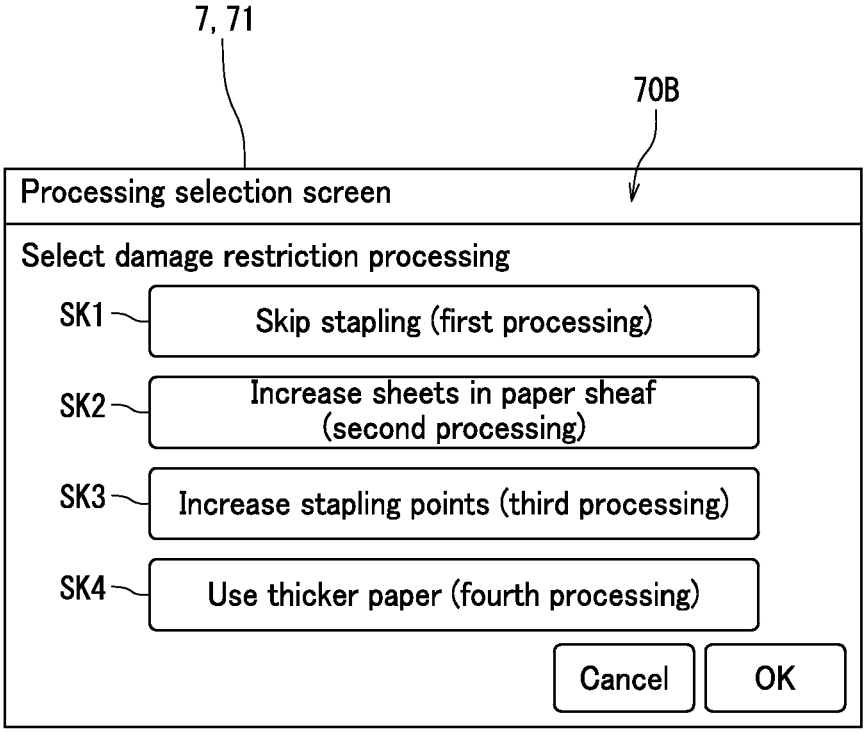
FIG. 5 illustrates an example of a processing selection screen displayed on the operation panel of the multifunction peripheral according to the embodiment of the present disclosure.

Upon receiving the selection of processing to be executed as the damage restriction processing from the user, the operation panel 7 displays a processing selection screen 70B illustrated in FIG. 5. The processing selection screen 70B includes selection keys SK1-SK4 that respectively correspond to the first to fourth processing. Upon the main control section 110 detecting a touch operation on any of the selection keys SK1-SK4, the main control section 110 sets processing corresponding to the touched selection key as the damage restriction processing.

The operation panel 7 receives the user's selection of processing to be executed as the damage restriction processing in advance. The operation panel 7 for example displays the processing selection screen 70B upon reception of a specific operation. The specific operation is predetermined as an operation that causes display of the processing selection screen 70B. Through the above, the user can make a selection in advance of processing that is to be executed by the job executing section 100J as the damage restriction processing.

Alternatively, the operation panel 7 may receive a selection from the user of processing to be executed as the damage restriction processing each time the number of sheets in the target paper sheaf is smaller than the threshold sheet number. For example, when a detection result of the number of sheets in the target paper sheaf is that the number of sheets is smaller than the threshold sheet number, the main control section 110 instructs the operation panel 7 to display the processing selection screen 70B.

<Control Flow for Execution of Job Involving Stapling Processing>

Figure 6:
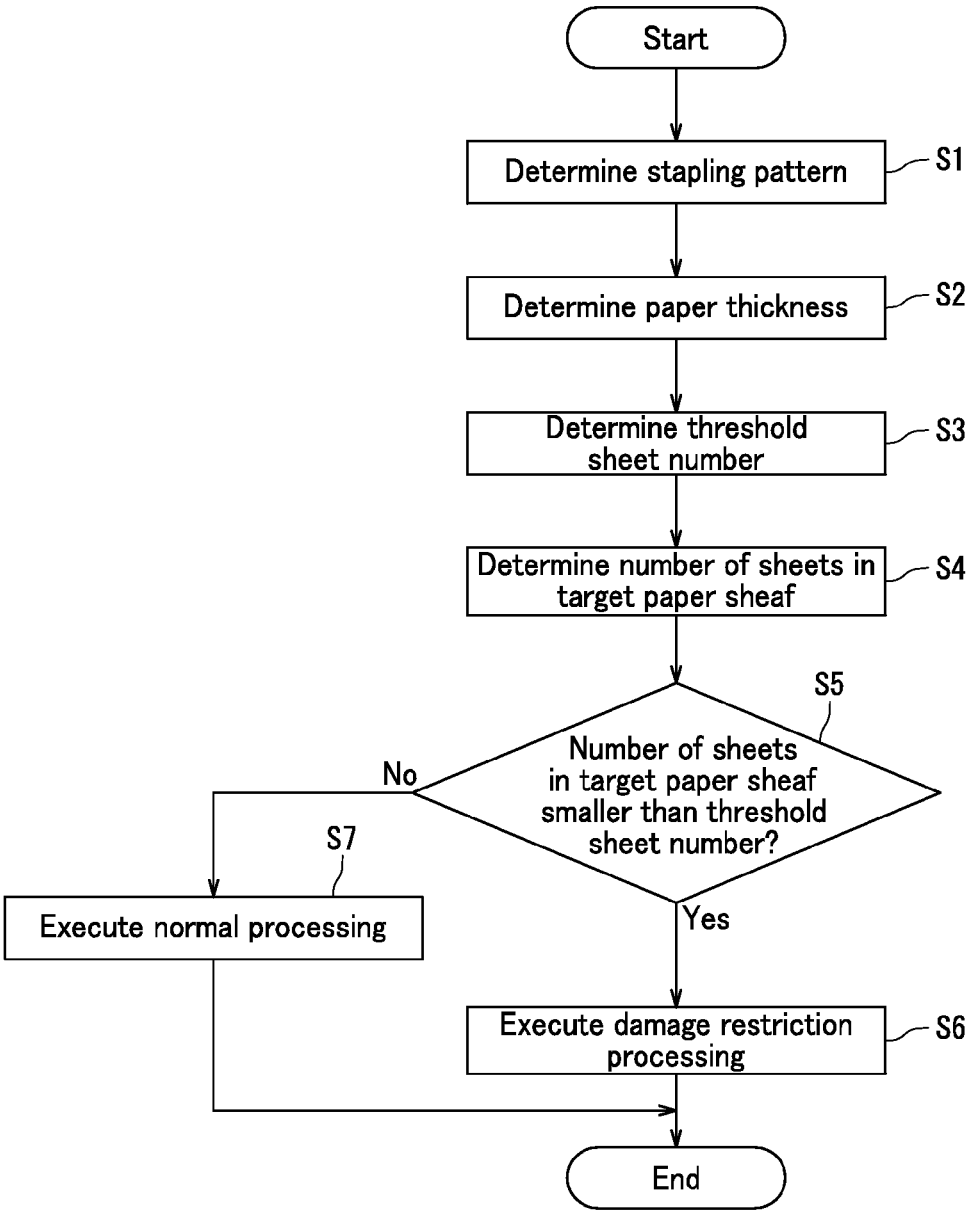
FIG. 6 is a flowchart illustrating control flow during execution of a job involving stapling processing in the multifunction peripheral according to the embodiment of the present disclosure.

The following explains, with reference to the flowchart in FIG. 6, control flow when a job (for example, a copy job or a print job) involving stapling processing is executed.

First, at the start point of the flowchart in FIG. 6, processing to be executed as the damage restriction processing has been preset. In other words, the user has selected processing to be executed as the damage restriction processing in advance. The flowchart in FIG. 6 starts upon the multifunction peripheral 100 receiving an execution instruction for a job involving stapling processing.

In Step S1, the main control section 110 determines the number and position of stapling points as stipulated by a stapling pattern designated by the user. Next, in Step S2, the main control section 110 determines the paper thickness of paper P loaded in a paper feed cassette 33 designated by the user. It should be noted that the main control section 110 may alternatively determine the stapling pattern designated by the user after determining the paper thickness of the paper P loaded in the paper feed cassette 33 designated by the user. In Step S3, the main control section 110 determines a threshold sheet number based on the stapling pattern designated by the user and the paper thickness of the paper P loaded in the paper feed cassette 33 designated by the user.

Next, in Step S4, the main control section 110 determines the number of sheets in a target paper sheaf. In a situation in which a copy job is executed, the main control section 110 determines the number of sheets in the target paper sheaf based on image data of a document obtained through scanning of the document by the image scanning section 1. In a situation in which a print job is executed, the main control section 110 determines the number of sheets in the target paper sheaf based on print data received from the user terminal 300. The print data is data that includes image data.

Next, in Step S5, the main control section 110 determines whether or not the number of sheets in the target paper sheaf is smaller than the threshold sheet number. When the result of the determination is that the number of sheets in the target paper sheaf is smaller than the threshold sheet number, the control flow proceeds to Step S6. In Step S6, the main control section 110 instructs the job executing section 100J to execute the damage restriction processing.

On the other hand, when the main control section 110 determines that the number of sheets in the target paper sheaf is not smaller than the threshold sheet number in Step S5, the control flow proceeds to Step S7. In Step S7, the main control section 110 instructs the job executing section 100J to execute normal processing. Upon receiving an execution instruction for normal processing, the job executing section 100J conveys paper P loaded in the paper feed cassette 33 designated by the user and prints an image on the paper P based on image data of a print target. The printing section 2 conveys the paper P toward the finishing processing section 200 once printing is complete. During the above, additional paper P is not conveyed to the finishing processing section 200. Next, the finishing processing section 200 performs stapling processing on the target paper sheaf, which is composed of a plurality of sheets of the paper P conveyed from the printing section 2, at the stapling points stipulated by the stapling pattern designated by the user. The finishing processing section 200 subsequently ejects the target paper sheaf once the stapling processing is complete.

As explained above, the multifunction peripheral 100 (image forming apparatus) according to the present embodiment includes the job executing section 100J and the main storage section 112 (storage section) that stores information. The job executing section 100J includes the printing section 2 that prints an image on paper P and the finishing processing section 200. The finishing processing section 200 performs stapling processing on a paper sheaf composed of a plurality of sheets of paper P conveyed from the printing section 2. The finishing processing section 200 performs the stapling processing based on a stapling pattern designated by a user from among a plurality of stapling patterns that each stipulate a position of each of one or more stapling points and the number of stapling points. The main storage section 112 stores a threshold sheet number indicating a predetermined minimum number of paper sheaf sheets that is used as a determination criterion for whether or not to execute damage restriction processing. The damage restriction processing is processing for restricting damage to the paper sheaf that is attributable to the paper sheaf having undergone stapling processing. When the number of sheets in a target paper sheaf that is a target of the stapling processing is smaller than the threshold sheet number, the job executing section 100J executes, as the damage restriction processing, one or more of: first processing of ejecting paper P without performing the stapling processing; second processing of performing the stapling processing after increasing the number of sheets in the target paper sheaf to the threshold sheet number; and third processing of performing the stapling processing at a larger number of stapling points than the number of stapling points stipulated by the stapling pattern designated by the user.

In the present embodiment, the job executing section 100J executes one or more of the first processing, the second processing, and the third processing as the damage restriction processing in a situation in which the number of sheets in the target paper sheaf is smaller than the threshold sheet number. Therefore, it possible to restrict damage to the target paper sheaf that is attributable to the target paper sheaf having undergone stapling processing. More specifically, in a situation in which the job executing section 100J executes the first processing as the damage restriction processing, the job executing section 100J does not perform the stapling processing on the target paper sheaf. Therefore, damage attributable to stapling processing does not occur to the target paper sheaf. In a situation in which the job executing section 100J executes the second processing as the damage restriction processing, the number of sheets in the target paper sheaf is increased. Therefore, it is possible to restrict damage to the target paper sheaf that is attributable to the target paper sheaf having undergone stapling processing. In a situation in which the job executing section 100J executes the third processing as the damage restriction processing, the number of stapling points on the target paper sheaf is increased. Therefore, it is possible to restrict damage to the target paper sheaf that is attributable to the target paper sheaf having undergone stapling processing.

In the present embodiment, as explained above, in a situation in which there are a plurality of paper feed cassette 33 loaded with paper P of different paper thicknesses relative to one another, when the number of sheets in the target paper sheaf is smaller than the threshold sheet number, the job executing section 100J executes, as the damage restriction processing, one or more of: the first processing; the second processing; the third processing; and fourth processing of printing an image on paper P having a larger paper thickness than a paper thickness of paper P loaded in a paper feed cassette 33 designated by the user from among the plurality of paper feed cassettes 33 and conveying the paper P on which the image is printed to the finishing processing section 200. In a situation in which the job executing section 100J executes the fourth processing as the damage restriction processing in the configuration described above, the target paper sheaf is composed of stronger paper P—that is, composed of paper P having a larger paper thickness. Therefore, it is possible to restrict damage to the target paper sheaf that is attributable to target paper sheaf having undergone stapling processing.

In the present embodiment, as explained above, the main storage section 112 stores a threshold sheet number for each of the plurality of stapling patterns. The larger the number of stapling points stipulated by each of the stapling patterns, the smaller the threshold sheet number corresponding thereto is set. The job executing section 100J executes the damage restriction processing when the number of sheets in the target paper sheaf is smaller than the threshold sheet number corresponding to the stapling pattern designated by the user. Damage tends to occur more easily to a paper sheaf having a small number of stapling points than a paper sheaf having a large number of stapling points when both of the paper sheaves are composed of the same number of sheets. Therefore, preferably a threshold sheet number is set for each number of stapling points that is stipulated by any of the stapling patterns.

In the present embodiment, as described above, the threshold sheet number for each of the stapling patterns is a plurality of threshold sheet numbers respectively corresponding to a plurality of different paper thicknesses, and the larger each of the paper thicknesses, the smaller the threshold sheet number corresponding thereto is set. The job executing section 100J executes the damage restriction processing when the number of sheets in the target paper sheaf is smaller than the threshold sheet number corresponding to the stapling pattern designated by the user and corresponding to the paper thickness of the paper P loaded in the paper feed cassette 33 designated by the user. Damage tends to occur more easily to a paper sheaf composed of paper P having a small paper thickness than a paper sheaf composed of paper P having a large paper thickness when both of the paper sheaves are composed of the same number of sheets. Therefore, threshold sheet numbers are preferably further categorized for each of a plurality of different paper thicknesses.

In the present embodiment, as explained above, the operation panel 7 functioning as the reception section receives a selection in advance from the user of processing from among the first processing, the second processing, the third processing, and the fourth processing that the job executing section 100J is to execute as the damage restriction processing. Alternatively, the operation panel 7 receives a selection from the user of processing from among the first processing, the second processing, the third processing, and the fourth processing that is to be executed as the damage restriction processing, each time the number of sheets in the target paper sheaf is smaller than the threshold sheet number. The above enables the user the select preferred processing from among the first processing, the second processing, the third processing, and the fourth processing as the damage restriction processing. Therefore, such a configuration is easier for a user to use. In other words, a situation can be avoided in which processing that is not intended by the user is executed as the damage restriction processing.

The presently disclosed embodiment is merely provided as an illustrative example in all aspects and should not be considered to be limiting. The scope of the present disclosure is indicated by the claims rather than the explanation of the above embodiment and further includes all alterations that are equivalent in meaning and scope to the claims.

What is claimed is:

1. An image forming apparatus comprising:

a job executing section including a printing section that prints an image on paper and a finishing processing section; and a storage section that stores information, wherein the finishing processing section performs stapling processing on a paper sheaf composed of a plurality of sheets of paper conveyed from the printing section, the finishing processing section performing the stapling processing based on a stapling pattern designated by a user from among a plurality of stapling patterns that each stipulates a position of each of one or more stapling points and the number of stapling points, the storage section stores a threshold sheet number indicating a predetermined minimum number of paper sheaf sheets that is used as a determination criterion for whether or not to execute damage restriction processing, and when the number of sheets in a target paper sheaf that is a target of the stapling processing is smaller than the threshold sheet number, the job executing section executes, as the damage restriction processing, one or more of:

first processing of ejecting paper without performing the stapling processing; second processing of performing the stapling processing after increasing the number of sheets in the target paper sheaf to the threshold sheet number; and third processing of performing the stapling processing at a larger number of stapling points than the number of stapling points stipulated by the stapling pattern designated by the user.

2. The image forming apparatus according to claim 1, wherein the printing section includes a plurality of paper cassettes that are each loaded with paper, and in a situation in which the paper cassettes are loaded with paper of different paper thicknesses relative to one another, when the number of sheets in the target paper sheaf is smaller than the threshold sheet number, the job executing section executes, as the damage restriction processing, one or more of:

the first processing;

the second processing;

the third processing; and fourth processing of printing an image on paper having a larger paper thickness than a paper thickness of paper loaded in a paper cassette designated by the user from among the plurality of paper cassettes and conveying the paper on which the image is printed to the finishing processing section.

3. The image forming apparatus according to claim 2, wherein the storage section stores a threshold sheet number for each of the plurality of stapling patterns, the larger the number of stapling points stipulated by each of the stapling patterns, the smaller the threshold sheet number corresponding thereto is set, and the job executing section executes the damage restriction processing when the number of sheets in the target paper sheaf is smaller than the threshold sheet number corresponding to the stapling pattern designated by the user.

4. The image forming apparatus according to claim 3, wherein the threshold sheet number for each of the stapling patterns is a plurality of threshold sheet numbers respectively corresponding to a plurality of different paper thicknesses, and the larger each of the paper thicknesses, the smaller the threshold sheet number corresponding thereto is set, and the job executing section executes the damage restriction processing when the number of sheets in the target paper sheaf is smaller than the threshold sheet number corresponding to the stapling pattern designated by the user and corresponding to the paper thickness of the paper loaded in the paper cassette designated by the user.

5. The image forming apparatus according to claim 2, further comprising a paper thickness determination section that determines the paper thickness of the paper loaded in each of the plurality of paper cassettes, wherein the paper thickness determination section includes an optical sensor or an ultrasound sensor.

6. The image forming apparatus according to claim 1, further comprising a reception section that receives a selection from the user of processing to be executed as the damage restriction processing by the job executing section.

7. The image forming apparatus according to claim 6, wherein the reception section receives the selection from the user of processing to be executed as the damage restriction processing by the job executing section each time the number of sheets in the target paper sheaf is smaller than the threshold sheet number.

* * * * *